United States Patent [19]

Jurasek

[11] 3,979,006

[45] Sept. 7, 1976

[54] RIGID CONTAINER

[75] Inventor: Stanley J. Jurasek, Concord Township, Jackson County, Mich.

[73] Assignee: Eagle-Picher Industries, Inc., Cincinnati, Ohio

[22] Filed: July 28, 1975

[21] Appl. No.: 599,402

Related U.S. Application Data

[62] Division of Ser. No. 323,513, Jan. 15, 1973, Pat. No. 3,907,150.

[52] U.S. Cl. ..... 220/19; 206/513

[51] Int. Cl.[2] ..... B65D 7/20

[58] Field of Search ..... 220/19; 206/513; 108/53

[56] References Cited

UNITED STATES PATENTS

| | | | |
|---|---|---|---|
| 2,898,122 | 8/1959 | Beckner | 220/19 |
| 3,442,231 | 5/1969 | Jurasek | 108/55 |
| 3,478,914 | 11/1969 | Williams | 220/19 |

*Primary Examiner*—William Price
*Assistant Examiner*—Joseph M. Moy
*Attorney, Agent, or Firm*—Woodhams, Blanchard and Flynn

[57] ABSTRACT

A material handling container comprising a deck bed having a plurality of rigid posts extending upwardly therefrom. Wire mesh walls extend between and are rigidly secured to the posts to define a rigid, non-foldable wall structure. At least one of the walls may have a hingedly connected wall section adapted to be releasably retained in an upright position by latch means.

3 Claims, 5 Drawing Figures

FIG. 1
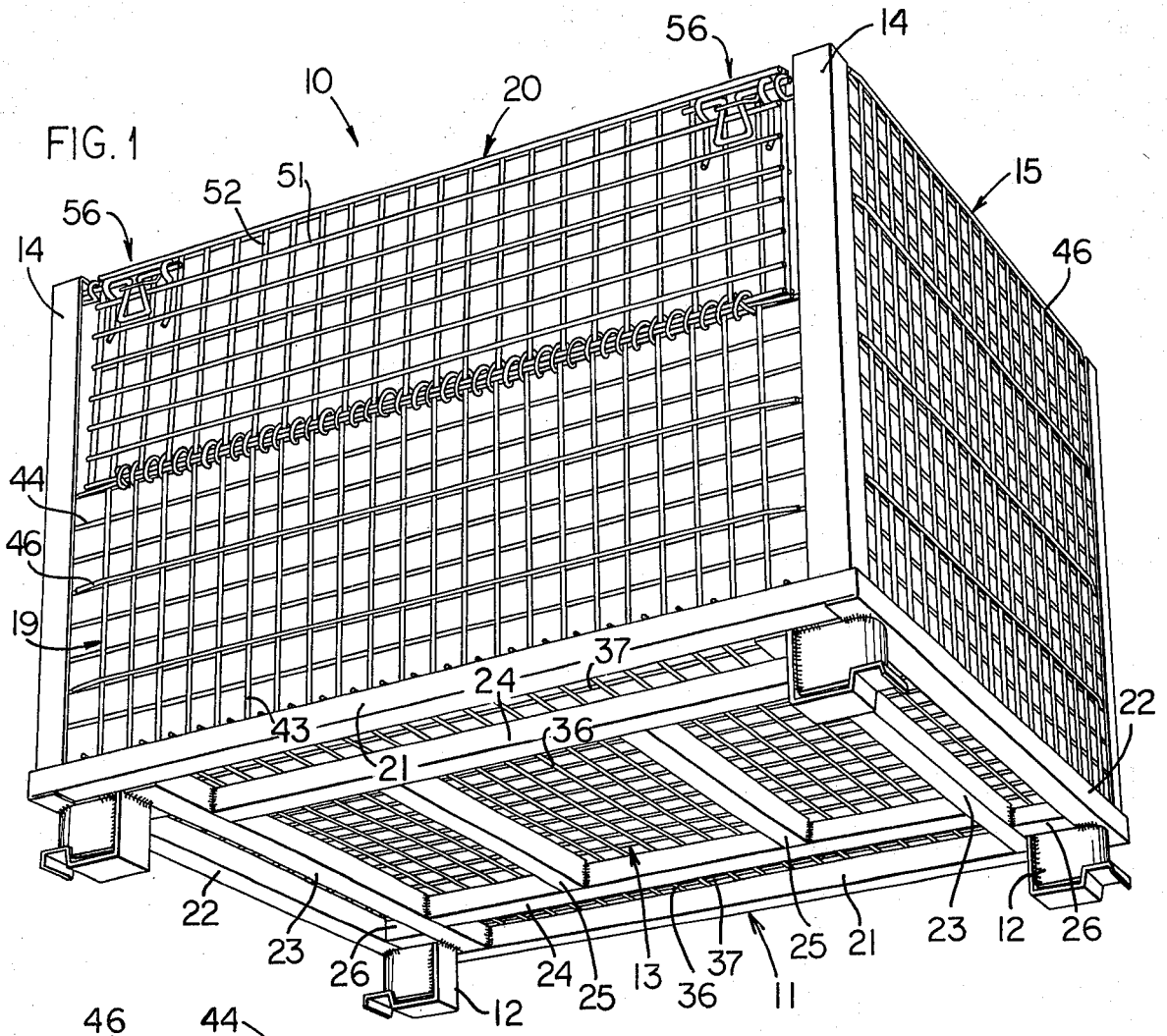
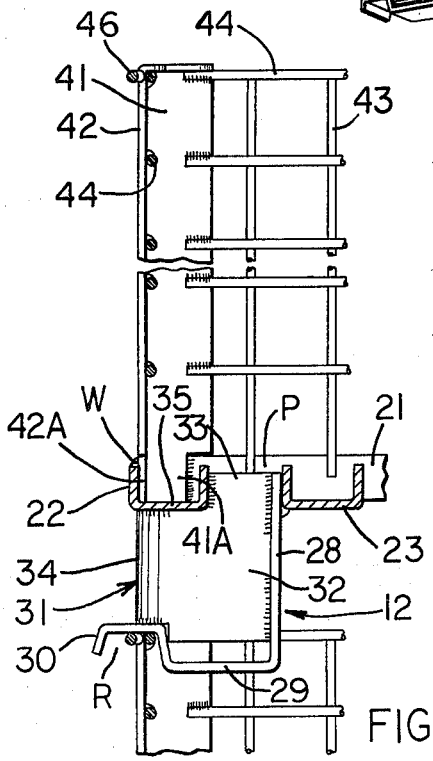
FIG. 3
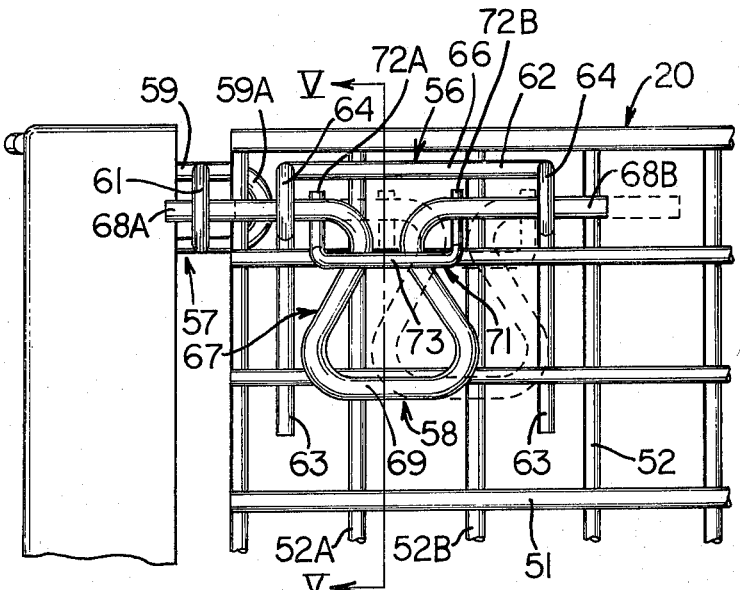
FIG. 4

RIGID CONTAINER

This is a division, of application Ser. No. 323,513, filed Jan. 15, 1973, now U.S. Pat. No. 3,907,150.

BACKGROUND OF THE INVENTION

1. Field of the Invention

This invention relates to a material handling container and, more particularly, to a rigid material handling container having wire mesh sides and bottom.

2. Description of the Prior Art

Material handling containers are available in a wide variety of types and constructions. A popular type of material handling container is a collapsible wire mesh container comprising hingedly connected front, rear and side walls mounted on a base and constructed and arranged so that the container can be folded more or less flat for storage and shipment. Such containers have limited load-carrying capacities and lack the ruggedness and durability required for certain applications. Also, it is known to make rigid containers of various materials, such as wood, but such containers lack the desired features of low weight, ready visibility of the contents of the container and ease of access to the contents. The rigid containers are not stackable with collapsible wire mesh containers of the same base dimensions.

Accordingly, it is an object of this invention to provide a rigid material handling container having improved ruggedness and durability, high load-carrying capacity, ready visibility of the contents, ease of access to the contents and which is stackable with either similar rigid material handling containers or collapsible wire mesh containers, of the same base dimensions.

It is a further object of this invention to provide a rigid material handling container having a relatively low weight but which is capable of holding heavy loads, so as to provide a lower tare to net load factor than is provided by prior rigid material handling containers.

It is a further object of this invention to provide an improved reversible latch structure for the gate of a material handling container so that the same latch can be used for either the left-hand corner or the right-hand corner of the gate.

SUMMARY OF THE INVENTION

According to the invention there is provided a material handling container comprising a deck bed made of structural members joined at their ends to form a peripheral frame. Legs extend downwardly from the deck bed for contact with a supporting surface or for stacking on another container of the same base dimensions. Rigid posts extend upwardly from the deck bed and their lower ends are fixedly attached to the deck bed. Wire mesh walls are rigidly attached to the posts and to the deck bed to provide an open-topped, rigid, non-foldable enclosure extending upwardly from the deck bed.

In a preferred embodiment of the invention, at least one wall of the container has one hingedly mounted section comprising a gate which can be lowered to provide more convenient access to the contents of the container. Latch means are provided to releasably hold the gate in an upright position.

BRIEF DESCRIPTION OF THE DRAWINGS

FIG. 1 is a perspective view of a preferred material handling container according to the invention.

FIG. 3 is a sectional view substantially as taken along line III—III of FIG. 2 and showing the stacking relationship of two containers.

FIG. 4 is an enlarged front view of a fragment of FIG. 1 and showing the latch means.

DESCRIPTION OF THE PREFERRED EMBODIMENT

Figure 2:
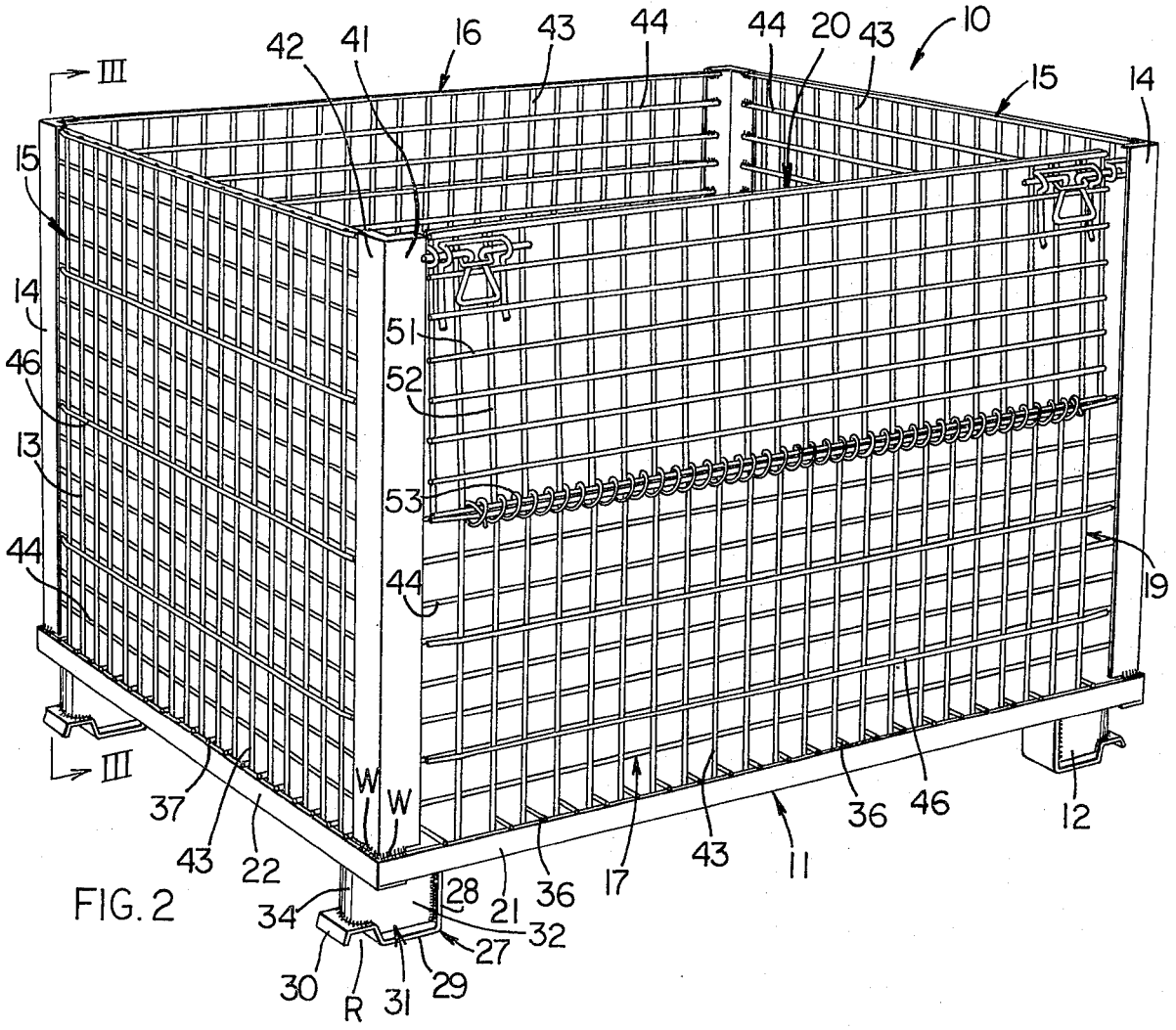
FIG. 2 is a perspective view of the material handling container, taken from a different aspect than FIG. 1.
Figure 5:
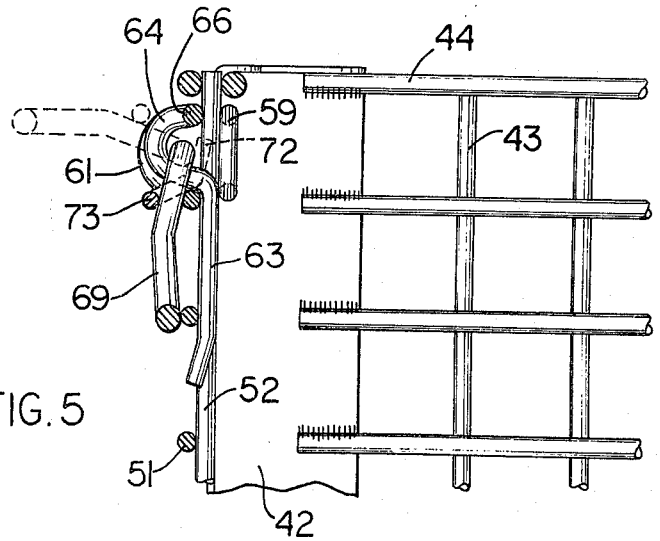
FIG. 5 is a sectional view taken along the line V-V of FIG. 4.

Referring to FIGS. 1 and 2, the material handling container 10 embodying the invention comprises a rectangular deck bed 11 having legs 12 secured thereto adjacent the corners thereof and also having a deck mat 13 secured thereto. Four upright posts 14 are secured, as by welding, to the deck bed at the corners thereof and said posts extend upwardly therefrom. Side walls 15, rear wall 16 and front wall 17 are secured to the posts 14 as by welding. The front wall 17 is comprised of a rigid immovable lower portion 19 and an upper portion 20 which is hingedly connected to the upper edge of said lower portion so that it can be moved outwardly and downwardly for more convenient access to the interior of the container.

Referring to FIG. 1, the deck bed 11 preferably is of the same construction as the deck bed illustrated in U.S. Pat. No. 3,442,231, although it will be apparent that deck beds of a variety of different constructions can be used. Specifically, the deck bed 11 is formed of upwardly facing U-shaped channel sections and comprises side members 21 and end members 22 extending between the ends of the side members 21. Intermediate end members 23 extend between the side members 21 and in parallel spaced relation to the end members 22. Intermediate side members 24 extend between the intermediate members 23 in spaced parallel relation to the side members 21. Finally, inner members 25 extend between the intermediate side members 24 in spaced parallel relation to the end members 22 and intermediate members 23. The members are secured to one another by welding. Pocket defining structures are provided at the corners of the peripheral frame and comprise channel sections 26 which are welded between the intermediate and end member 23, 22 at the corners to define the leg receiving pockets P which are square and receive a portion of the leg 12 as presently to be described.

Referring to FIG. 1, each leg 12 is made of two pieces welded together and comprising a flat strip 27 that includes a vertical wall 28, a horizontal bearing surface 29 and an end 30 that is bent upwardly to define a recess R which engages the walls of the adjacent lower container when like containers are stacked. The other member 31 of the leg is U-shaped and includes spaced walls 32 that have their vertical edges welded to the vertical wall 28. The uppermost portions 33 of the walls 32 cooperate with the upper end of the wall 28 to define a square projection which is received in a pocket P (FIG. 3). The walls 32 and connecting wall 34 have their upper ends cut away to form a shoulder 35 that is adapted to abut one of the peripheral frame members of the deck bed. As shown in FIG. 3, the leg can be inserted in the pocket so that shoulder 35 engages an end member 22 and the recess R extends parallel to the end member 21. Alternatively, the leg can be inserted so that the shoulder 35 engages a side member 21 and the recess R extends parallel to the side member. In this fashion, the container can be adapted to an arrangement wherein the recesses engage either the side or end walls depending upon the manner in which the containers are to be stacked.

As shown in FIGS. 1 and 2, the deck mat 13 is of mesh-like construction and comprises a lower series of slats or rods 36 which extend in parallel relation to the end members 22 and a second series of slats or rods 37 that extend in parallel relationship to the side members 21. The slats 36, 37 are welded to one another where they cross and they are also welded to the upper edges of the members 21 and 22 with which they are in engagement. The slats 36 also can be welded to the upper edges of the members 24.

Each of the posts 14 is an elongated upright angle member having two flanges 41 and 42 extending at right angles to each other. As shown in FIGS. 2 and 3, the lower ends 41A and 42A of the posts 14 extend into the junctures of the members 21 and 22 at the corners of the deck mat with the lower ends of flanges 41 and 42 being in snug contact with the inner surfaces of the outer walls of said members. The posts 14 are secured to the outer walls of the members 21 and 22 by welds W. Thus the flanges 41 and 42 are inset within the members 21 and 22 in order to strengthen the assembly and protect same from damage during handling.

The two side walls 15 and rear wall 16 are of wire mesh construction. The vertical rods or slats 43 thereof are welded at their lower ends to the inner surfaces of outer walls of the members 21 and 22. The horizontal rods or slats 44 thereof are welded at their ends to the inner surfaces of the flanges 41 and 42 whereby said side walls 15 and end wall 16 are rigidly connected to the posts 14 and the deck bed 11. Horizontal reinforcing rods 46 are secured to the outer sides of the walls 15 and 16 at vertically spaced locations, the uppermost reinforcing rod in each wall being located at the upper end thereof. The rods 43, 44 and 46 are welded to each other where they cross.

The upper ends of the flanges 41 and 42 are bent inwardly into horizontally extending position overlying the horizontal rods 44 and reinforcing rod 46 at the corners of the container.

In the preferred embodiment of the invention illustrated in the drawings, the front wall has a gate so that access to the contents of the container can be facilitated. However, in its broader aspects the invention contemplates containers in which the front wall is a rigid wall, the same as the rear wall 16. Also, gates can be provided in the side and/or rear walls in the same manner as the gate is provided in the front wall, as is described below, if more convenient access to the contents of the container is desired from the sides and/or rear of the container.

Referring again to the preferred embodiment of the invention, the lower portion 19 of the front wall is constructed and attached to the posts 14 and deck bed 11 in the same fashion as the side walls 15 and rear wall 16. The same reference numbers are applied to corresponding parts.

The upper portion or gate portion 20 of the front wall also is of wire mesh construction and is comprised of horizontal rods or slats 51 and vertical rods or slats 52 which are welded to each other where they cross. The width of the upper portion is less than the spacing between the adjacent edges of the two posts 14 at the front corners of the container so that said upper portion can be swung outwardly and downwardly. A wire helical coil 53 encircles the uppermost horizontal rod on the lower portion 19 and the lowermost horizontal rod on the upper portion 20, so that said coil defines a hinge between said upper and lower portions of said front wall.

A pair of lock structures 56 are provided to releasably retain the upper portion 20 of the front wall in upright position. The lock structures each comprise a keeper 57 secured to the adjacent front post 14 and a latch 58 attached to the adjacent upper corner of the upper portion 20. The keeper 57 is comprised of a U-shaped rod 59 secured to the post 14 and extending horizontally and parallel to the post. The innermost portion 59A of the rod 59 functions as a stop for limiting inward pivoting movement of the upper portion 20. The keeper 57 also includes a frontwardly projecting loop portion 61 which cooperates with the latch 58 as hereinafter further described.

The latch 58 is comprised of a one-piece rod 62 having a pair of vertical legs 63 which are welded to the horizontal rods 51 that it contacts on the inner sides thereof. Reversely bent, forwardly projecting loop portions 64 are provided at the upper ends of the legs 63. The reversely ben portions 64 are in horizontal alignment with the loop portion 61 when the wall portion is in upright position. The upper ends of the legs 63 are connected by a horizontal portion 66, which extends in front of the vertical rods 52 and is welded thereto. The latch 58 also includes a latch member 67 comprising a one-piece rod having straight horizontal end sections 68A and 68B which extend through the reversely bent portions 64 and an intermediate reversely bent handle portion 69. A generally U-shaped stop element 71 includes a pair of upright legs 72 secured to the sections 68A and 68B adjacent the inner ends thereof. The connecting web 73 of the element projects forwardly in front of the legs of the reversely bent handle portion 69 and is welded thereto. The parts of the latch 58 are arranged so that by pivoting the handle portion 69 upwardly to a substantially horizontal position, the latch 67 can be moved leftwardly and rightwardly into and out of positions in which the end section 68A extends through the loop 61. The latch 67 will automatically return to its vertical position, by gravity, when the lifting force is removed. In its lower vertical position, accidental disengagement of the end section from the loop 61 is prevented by the leg 72A abutting against the vertical rod 52A. Similarly when the latch is disengaged from the loop 61, accidental engagement thereof is prevented by the leg 72B abutting against the vertical rod 52B.

The latches 58 are symmetrical and reversible, that is, the same latch can be used for both the right and left hand corners of the upper portion 20 of the front wall.

Thus, the latch 58 can be moved from the position shown in solid lines in FIG. 4, in which the movable wall portion or gate 20 is retained in its upright position, to the position thereof shown in broken lines, in which said wall portion or gate is free to swing downwardly. The latch 58 will be releasably retained in either of said positions, but it can be manually moved between said positions when desired. It will be understood that sufficient clearances are provided to enable the legs 72A and 72B to clear the rods 52A and 52B when such movement is desired. Particularly the loops 64 are sufficiently large, relative to the diameters of rod sections 68A and 68B, to enable the latch member 67 to be pulled forwardly so that the free ends of the legs 72A and 72B will clear the rods 52A and 52B when the latch member 67 is in a horizontal position.

The container according to the present invention can be stacked with like containers or foldable containers of the same base dimensions as illustrated in FIG. 3. It will be apparent that a variety of leg constructions of different designs can be used in place of legs 12. The container construction is lightweight, but is strong and durable. The contents of the container are visible and readily accessible, even when containers are stacked. Dirt and debris cannot be trapped in the container.

A preferred embodiment of the invention has been illustrated and described, but it will be understood that the invention comprehends modifications thereof within the scope of the appended claims.

The embodiments of the invention in which an exclusive property or privilege is claimed are defined as follows:

1. A material handling container, comprising:

a deck bed comprised of structural members forming a substantially rectangular peripheral frame, said structural members being upwardly opening substantially U-shaped channels having parallel inner and outer upright walls interconnected at their lower ends by transversely extending base walls, said structural members being joined together at their ends to define upwardly opening, closed bottom sockets at the corners of said peripheral frame wherein the sidewalls of said sockets are defined by the inner and outer upright walls of said structural members and the closed bottom walls of said sockets are defined by the base walls of said structural members;

legs secured directly to the underside of the deck bed adjacent to the corners of said rectangular peripheral frame, said legs extending downwardly from the deck bed for engagement with a support surface or for stacking on another container of the same dimensions;

a plurality of upright rigid posts secured to and extending upwardly from said peripheral frame at the corners thereof, and with their lower end portions being disposed in said sockets, said posts each consisting essentially of an angle member having two flanges extending a right angle to each other, the lower ends of said posts substantially bottoming against the base walls of said structural members and the outer surfaces of the lower end portions to the two flanges of said posts being in abutting face-to-face contact with and extending parallel to the inner surfaces of the outer upright walls of the structural members and being welded thereto, said posts being separate from said legs and being connected thereto only by said deck bed;

upright wire mesh walls extending between and rigidly secured to said posts and defining a rigid, non-foldable enclosure extending upwardly from said deck bed, said wire mesh walls being comprised of vertically spaced, horizontally extending rods whose opposite ends extend into overlapping abutting face-to-face contact with the inner surfaces of the flanges of said posts and are welded thereto, said wire mesh walls also having horizontally spaced, vertically extending rods whose lower ends extend into overlapping abutting face-to-face contact with the inner surfaces of the outer walls of said structural members and are welded thereto;

a horizontal bottom wall of wire mesh construction extending across the bottom of the enclosure and comprising rods whose end portions extend across the upper ends of said structural members and are welded to the upper edges of the inner and outer upright walls of said structural members.

2. A material handling container as claimed in claim 1, including welding material extending between said flanges and the outward walls of said channels substantially at the upper edges thereof.

3. A material handling container as claimed in claim 1, in which the upper ends of said flanges of said posts are bent inwardly into a substantially horizontally extending position overlying the ends of the uppermost horizontal rods of said walls.

* * * * *